US012329231B2

(12) United States Patent
Sasser

(10) Patent No.: US 12,329,231 B2
(45) Date of Patent: Jun. 17, 2025

(54) COVER FOR HEADWEAR CLOSURE WITH INTEGRATED MAGNET

(71) Applicant: Dylan McClain Sasser, St Simons Island, GA (US)

(72) Inventor: Dylan McClain Sasser, St Simons Island, GA (US)

( * ) Notice: Subject to any disclaimer, the term of this patent is extended or adjusted under 35 U.S.C. 154(b) by 0 days.

(21) Appl. No.: 18/407,684

(22) Filed: Jan. 9, 2024

(65) Prior Publication Data

US 2024/0298736 A1 Sep. 12, 2024

Related U.S. Application Data

(60) Provisional application No. 63/451,507, filed on Mar. 10, 2023.

(51) Int. Cl.
*A42B 7/00* (2006.01)
*A44B 9/00* (2006.01)

(52) U.S. Cl.
CPC ..... *A42B 7/00* (2013.01); *A44B 9/00* (2013.01); *A44D 2203/00* (2013.01)

(58) Field of Classification Search
CPC ..... A42B 7/00; A44D 2203/00; A41F 1/002
See application file for complete search history.

(56) References Cited

U.S. PATENT DOCUMENTS 5,287,559 A 2/1994 Christiansen et al.
5,600,855 A * 2/1997 Ramirez ..... A42B 1/22 40/329
5,604,960 A * 2/1997 Good ..... A41F 1/002 24/66.1
5,918,316 A * 7/1999 Nathanson ..... G09F 21/02 2/244

(Continued)

FOREIGN PATENT DOCUMENTS

CN 2141207 Y 9/1993
KR 200303407 Y1 1/2003
KR 1020230076675 A 5/2003

OTHER PUBLICATIONS

Fatty Pack product listing and description, downloaded from the Internet on Jan. 25, 2024 at https://fattypack.com/ (pp. 1-4 in pdf).

(Continued)

*Primary Examiner* — Jason W San
*Assistant Examiner* — Rowland Do
(74) *Attorney, Agent, or Firm* — Mitch Harris, Atty at Law, LLC; Andrew M. Harris

(57) ABSTRACT

A cover for covering a headgear closure strap provides easy detachable securing of the hat to a magnetic surface, by including a magnet within the cover. The cover includes a cover body that encircles a cross-sectional profile of the headgear closure strap and extends along at least a portion of the extension of the headgear closure strap, a magnet disposed inside of the cover body behind a rear outer face of the cover body when the cover is installed on headgear, and a fastening mechanism for securing a top and a bottom wrap portion of the cover body together in front of a front inner face of the cover body when the cover body is installed on the headgear. The cover body may be formed from a sheet of flexible material with an edge folded over and fastened to form a pocket to retain the magnet.

12 Claims, 19 Drawing Sheets

(56) References Cited

U.S. PATENT DOCUMENTS

| | | | | |
|---|---|---|---|---|
| 6,006,362 | A | 12/1999 | Walsh | |
| 6,610,023 | B2 * | 8/2003 | Steponovich | A61F 5/0106 128/869 |
| 7,404,215 | B2 * | 7/2008 | Allen | A41D 27/145 2/232 |
| 10,292,444 | B2 * | 5/2019 | Dotzenrod | A42B 1/24 |
| D931,579 | S * | 9/2021 | Eldridge | D2/891 |
| 11,133,122 | B2 * | 9/2021 | Vazquez | A44B 99/00 |
| 2002/0152539 | A1 * | 10/2002 | Christian | A42B 1/24 2/209.13 |
| 2005/0217048 | A1 | 10/2005 | Elie et al. | |
| 2017/0135455 | A1 | 5/2017 | Kearsley | |
| 2018/0206814 | A1 * | 7/2018 | De La Fuente | A61B 7/02 |
| 2018/0281660 | A1 * | 10/2018 | Dahlin | F16B 2/08 |
| 2018/0368602 | A1 * | 12/2018 | Albanese | A44B 13/02 |
| 2019/0183423 | A1 * | 6/2019 | Radivojevic | A61B 5/6831 |
| 2020/0146383 | A1 * | 5/2020 | Eldridge | G09F 3/02 |

OTHER PUBLICATIONS

Cap Strap Cover product listing, downloaded from the Internet on Jan. 25, 2024 at https://www.martinivispak.com/en_ca/product/cap-strap-cover?4670 (pp. 1-3 in pdf).

* cited by examiner

COVER FOR HEADWEAR CLOSURE WITH INTEGRATED MAGNET

The present U.S. Patent Application claims priority under 35 U.S.C. 119 (e) to U.S. Provisional Patent Application 63/451,507 filed on Mar. 10, 2023, the disclosure of which is incorporated herein by reference.

BACKGROUND

1. Field of Disclosure

The field of representative embodiments of this disclosure relates generally to clothing accessories, and more particularly, to a cover for a headgear closure incorporating one or more magnets for detachably retaining the headgear on a surface having magnetic properties.

2. Description of the Related Art

Headgear is frequently used, and often necessary in outdoor environments, but can be an inconvenience when performing certain tasks where the headgear may interfere with the tasks. Caps having adjustable bands in the rear, such as "ball caps" or "trucker hats" are in common use in outdoor activities, and are generally easily removed. However, removal generally means that the cap is either held in one hand, reducing the ability to perform tasks, or is set down in a location that may lead to the cap being blown away, soiled, or lost. The cap may also be crushed if stepped on or driven-over.

Therefore, it would be desirable to provide device and method for securing a cap so that the cap will not be lost, crushed or soiled.

SUMMARY

The objectives of securing a cap is provided in a cap closure cover and its method of use.

The cover is a cover for covering a headgear closure strap. The cover includes a cover body defining a central passage for accepting the headgear closure strap. The cover body is configured to encircle a cross-sectional profile of the headgear closure strap and extend along at least a portion of the extension of the headgear closure strap. The cover also includes a magnet disposed inside of the cover body behind a rear outer face of the cover body when the cover body is installed on headgear, and a fastening mechanism for securing a top and a bottom wrap portion of the cover body together in front of a front inner face of the cover body when the cover body is installed on the headgear.

The summary above is provided for brief explanation and does not restrict the scope of the Claims. The description below sets forth example embodiments according to this disclosure. Further embodiments and implementations will be apparent to those having ordinary skill in the art. Persons having ordinary skill in the art will recognize that various equivalent techniques may be applied in lieu of, or in conjunction with, the embodiments discussed below, and all such equivalents are encompassed by the present disclosure.

DETAILED DESCRIPTION OF ILLUSTRATIVE EMBODIMENT

The present disclosure reveals hat closure covers that provide convenient storage of a hat when a vehicle of steel construction, or other object fixture having magnetic properties is at hand, via one or more magnets incorporated in the hat closure cover. The covers are covers for covering a headgear closure strap, and include a body with a central passage through which the headgear closure strap passes.

The cover body encircles the strap and has a magnet located inside behind the rear face of the cover when installed on headgear. The cover also has a fastening mechanism that secures a top and a bottom wrap portion of the cover body together when the cover body is installed on the headgear. The fastening mechanism may be, for example, snaps located on either side of the magnet, or a hook-and-loop type fastener pair.

Figure 1:
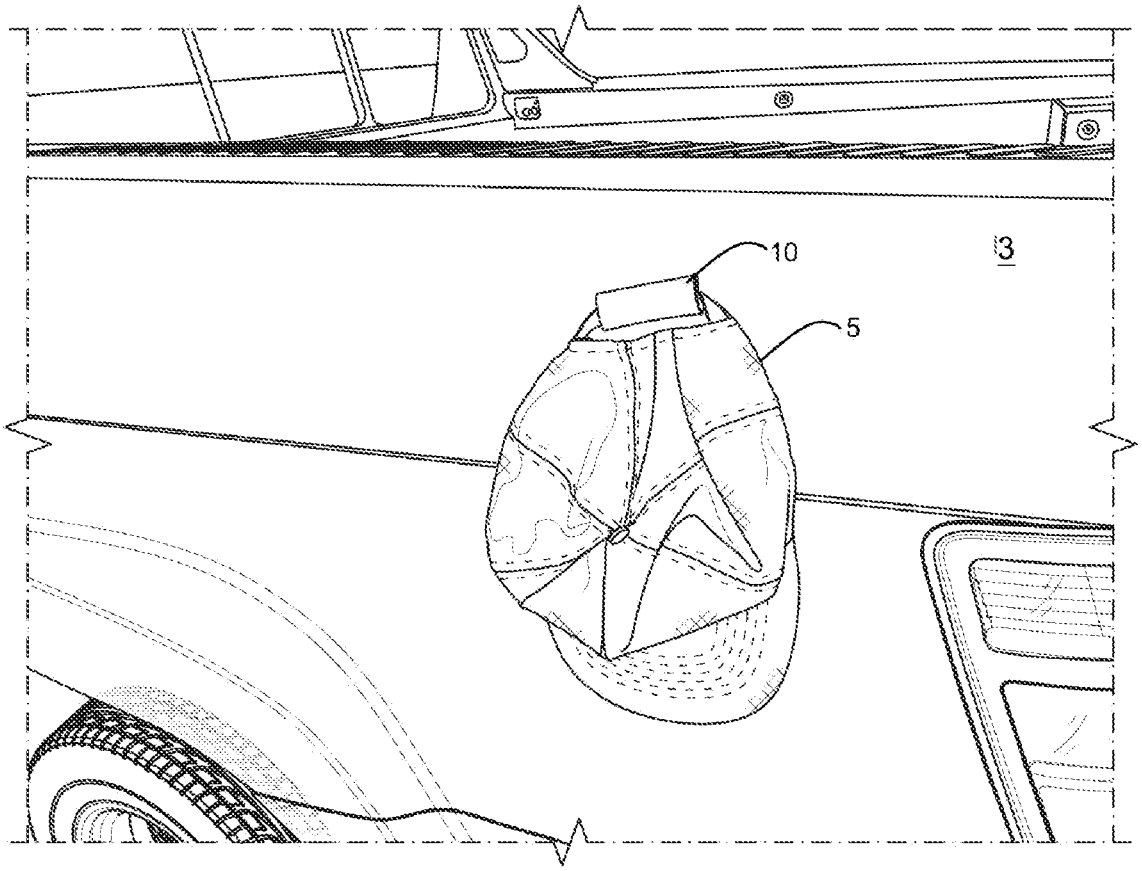
FIG. 1 is a pictorial view showing an example cover 10, installed on a cap 5 secured to a magnetic panel 3 of a vehicle, in accordance with an embodiment of the disclosure.

Referring now to FIG. 1, a pictorial view showing an example cover 10, installed on a cap 5 secured to a magnetic panel 3 of a vehicle is shown, in accordance with an embodiment of the disclosure. Magnetic panel 3 does not generally generate a magnetic field, but has magnetic properties, i.e., magnets are attracted to magnetic panel 3, and cover 10 provides a mechanism for securing cap 5 to such surfaces by the inclusion of one or more magnets in cover 10. By providing cover 10 that includes a magnet, cap 5 may be conveniently attached to any surface to which cover 10 is attracted, e.g., steel portions of a vehicle, fence, or portable gear having steel components, such as camp chairs and the like.

Figure 2:
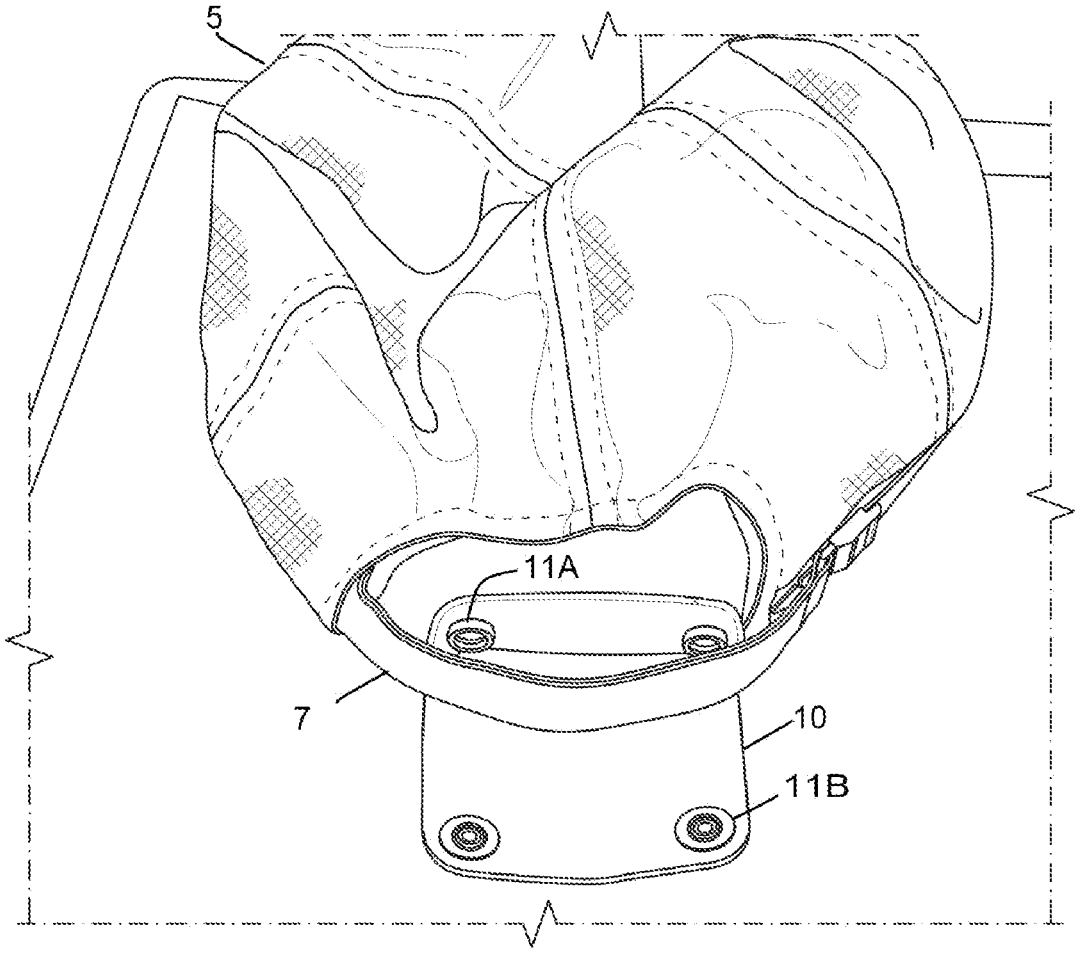
FIG. 2 is a pictorial view of example cover 10 in an open configuration for attachment to a cap 5, in accordance with an embodiment of the disclosure.

Referring now to FIG. 2, a pictorial view of example cover 10 in an open configuration for attachment to cap 5 is shown, in accordance with an embodiment of the disclosure. For the purposes of the instant disclosure, references to surfaces and views are relative to the front of cap 5, while cover 10 is generally positioned at a rear of cap 5, wrapped around a closure strap 7 of cap 5, ends of which are secured together by fasteners, which in the example embodiment are snap portions 11A and 11B. Reference is also made to an outer surface and view of cover 10, which is the surface opposite closure strap, while an inner surface and view of cover 10 is the surface that surrounds closure strap 7 and contacts closure strap 7 along at least a portion of the inner surface of cover 10.

Figure 3:
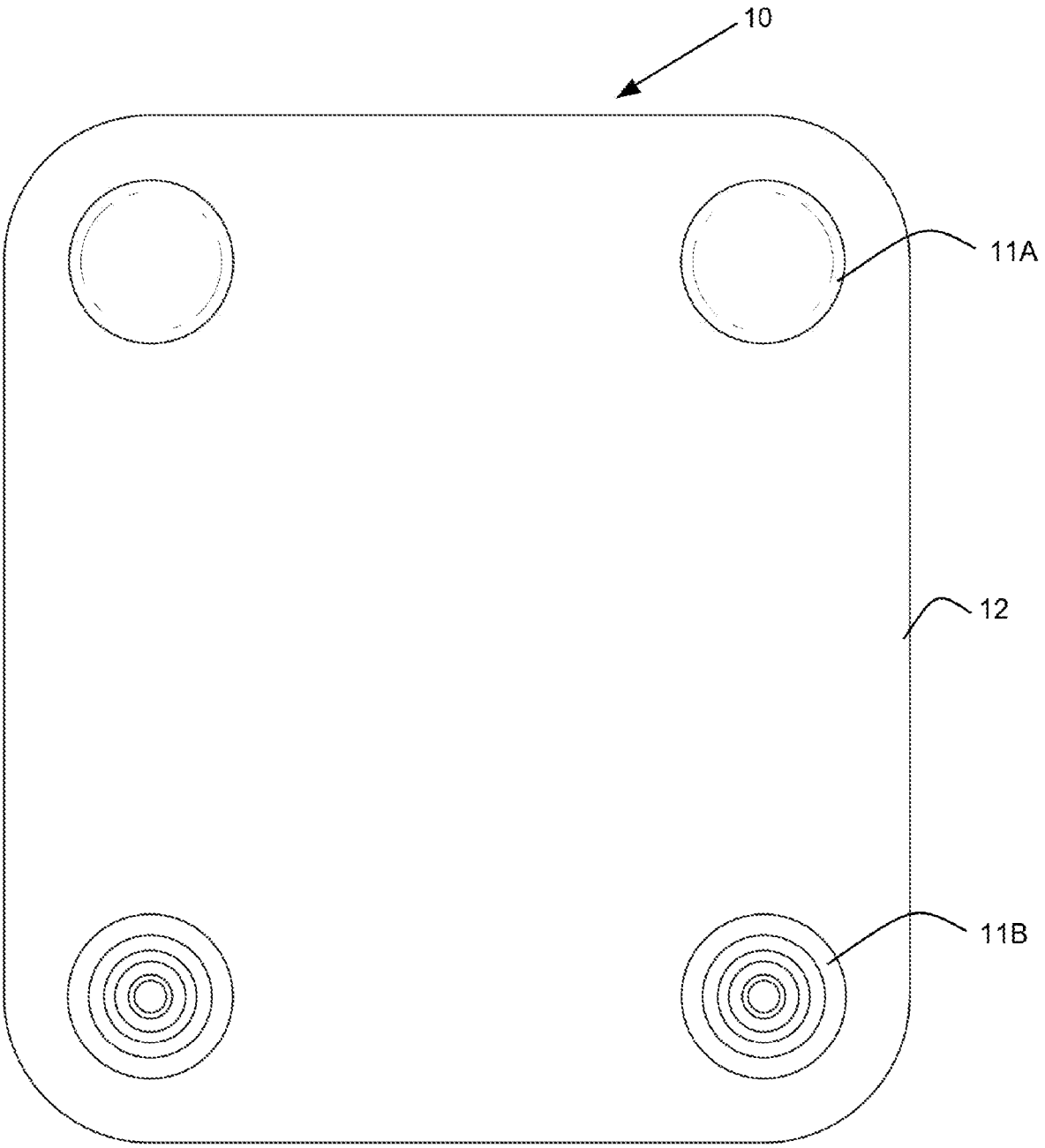
FIG. 3 is an outer view showing example cover 10, in an open and flattened configuration, in accordance with an embodiment of the disclosure.

Referring now to FIG. 3, an outer view showing example cover 10, in an open and flattened configuration, in accordance with an embodiment of the disclosure. Cover 10 is generally fabricated in a substantially rectangular shape with rounded corners by providing a substantially rectangular piece or pieces of a material from which a cover body 12 is fabricated, and to which fastener portions, e.g., snap portions 11A,11B are secured, e.g., by swedging components of snap portions 11A,11B after insertion through holes formed through cover body 12. Cover body is generally a flexible leather, false leather, or other fabric material which provides a decorative appearance, durability and the ability to add information, e.g., a monogram, name, logo or other identifier on the outer surface of cover body 12, so that the information is visible to others, when cover 10 is installed on a cap. Such information may be applied to a region of cover over the magnet, so that the information is visible to others, and may be applied in either orientation with respect to the top or bottom of cover 10, so that cover 10 may be install on cap 5 in either orientation as desired, or alternatively may be applied in a region of cover 10 opposite the magnet when cover 10 is installed on cap, so that the information is only visible at the inside of cap 5.

Figure 4:
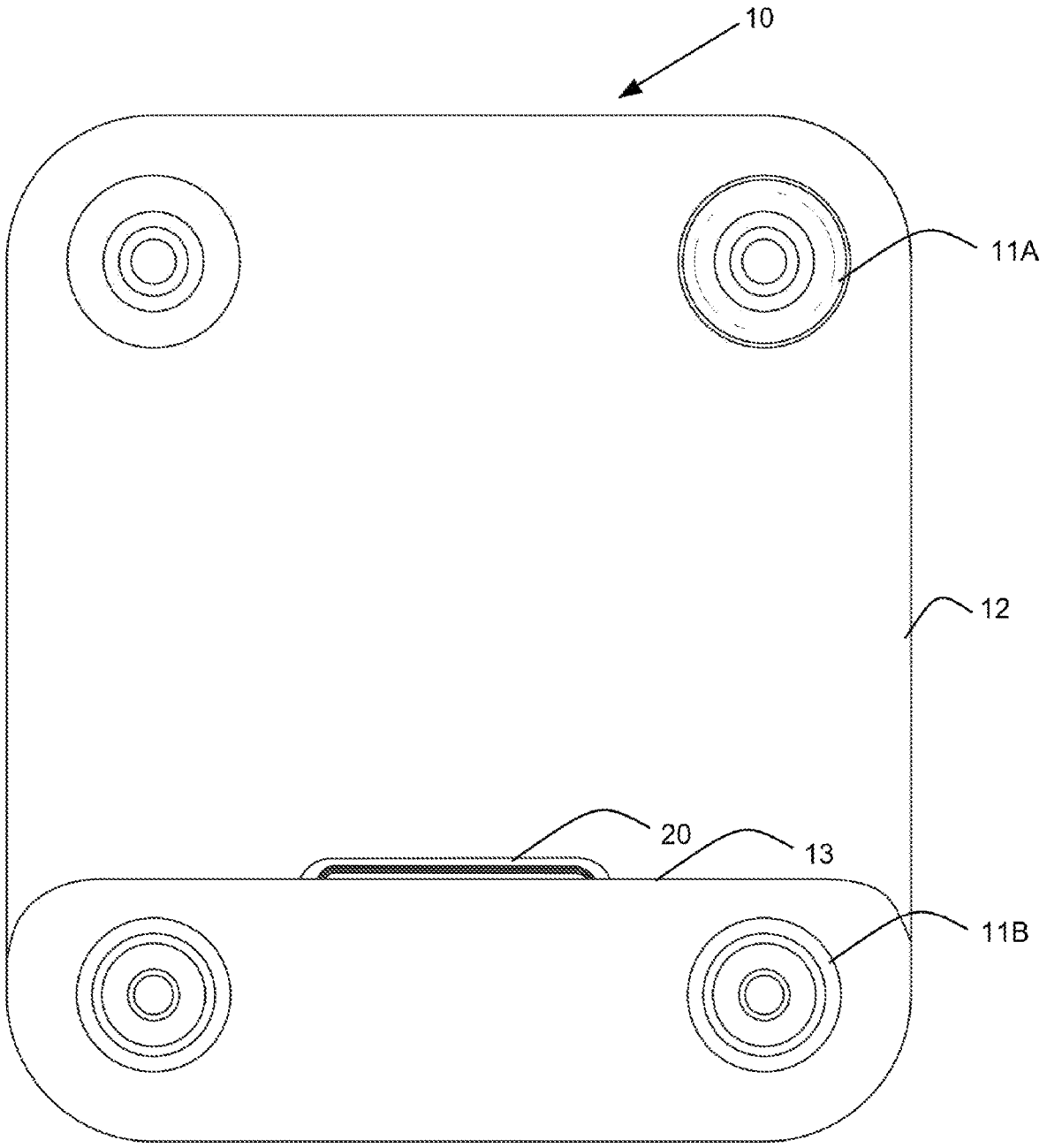
FIG. 4 is an inner view showing example cover 10, in an open and flattened configuration, in accordance with an embodiment of the disclosure.

Referring now to FIG. 4, an inner view showing example cover 10, in an open and flattened configuration is shown, in accordance with an embodiment of the disclosure. Active surfaces of snap portions 11A,11B are visible on the inner surface of cover 10, and a location of a magnet assembly 20 is shown, which is inserted inside of a pocket 13 formed by folding over a lower edge of material body 12 to form pocket 13, prior to swedging snap portions 11B through material. While magnet assembly 20 may be provided as a removable magnet, in the depicted embodiment, magnet assembly is secured within pocket 13 as will be described in further detail below.

Figure 5:
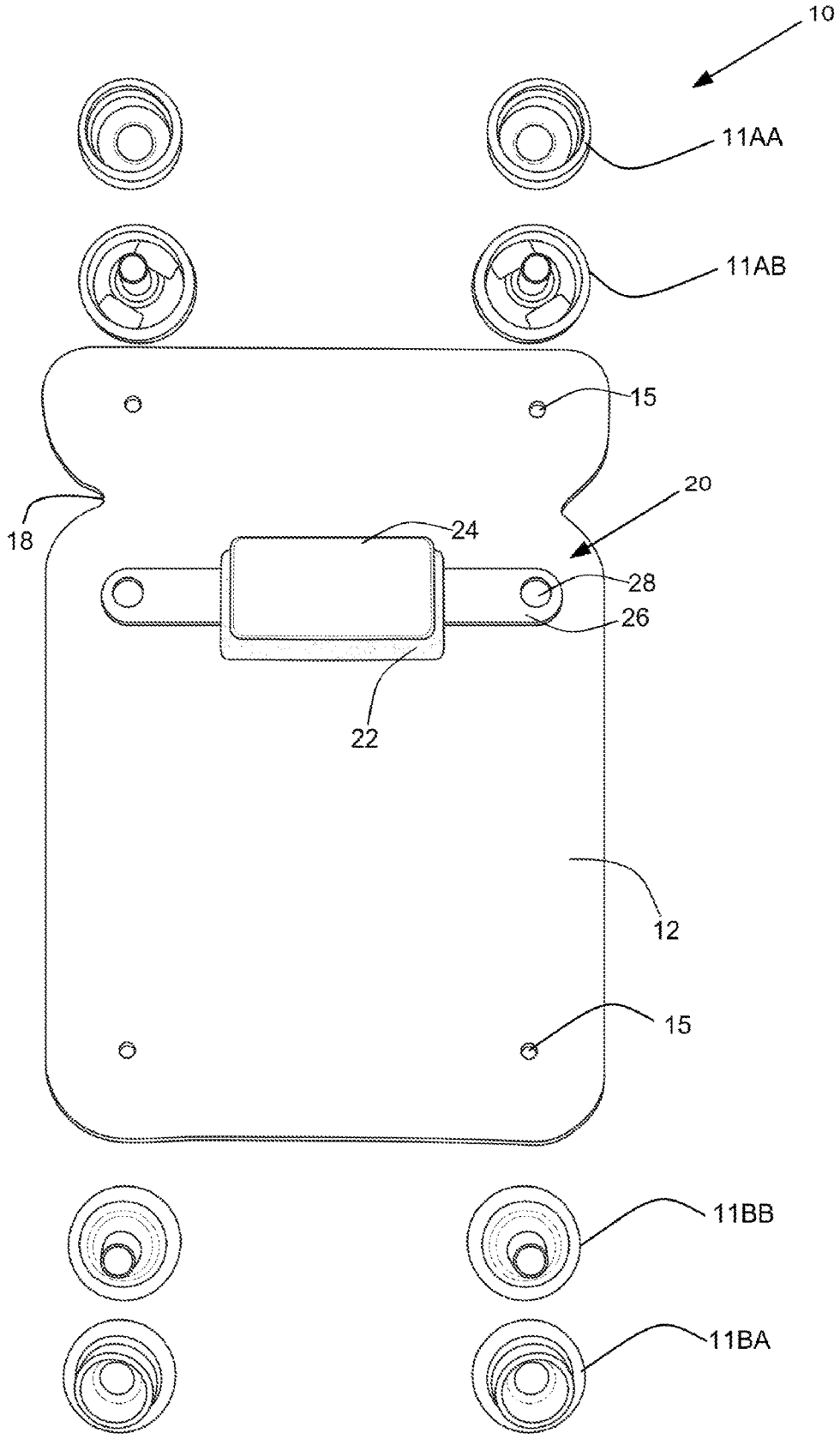
FIG. 5 is pictorial view showing components of example cover 10, prior to final assembly, in accordance with an embodiment of the disclosure.

Referring now to FIG. 5, a pictorial view showing components of example cover 10, prior to final assembly, in accordance with an embodiment of the disclosure. Cover body 12 has been perforated to form holes 15 for attachment of posts of outer portions 11AB of snap caps 11A through inner portions 11AA of snap caps 11A, posts of outer portions 11AB of snap caps 11A are also inserted through holes 28 formed through a pair of extensions 26 that extend from a center portion of a frame 22 that secures a magnet 24, generally a Neodymium magnet or other strong magnet, to magnet assembly. Magnet 24 may be glued to frame 22 or may be sufficiently secured within cover 10 by frame 22, without requiring adhesive. Posts of flange base portions 11BB of snap caps 11B are inserted through holes 15 and holes of inner portions 11BA of snap caps 11B and swedged to attach snap caps 11B. A pair of notches 18 are provided on either side of cover body 12 to provide rounded corners at the upper rear end of cover 10 when cover 10 is in the installed/closed configuration with snap portions 11A secured to snap portions 11B.

Figure 6A:
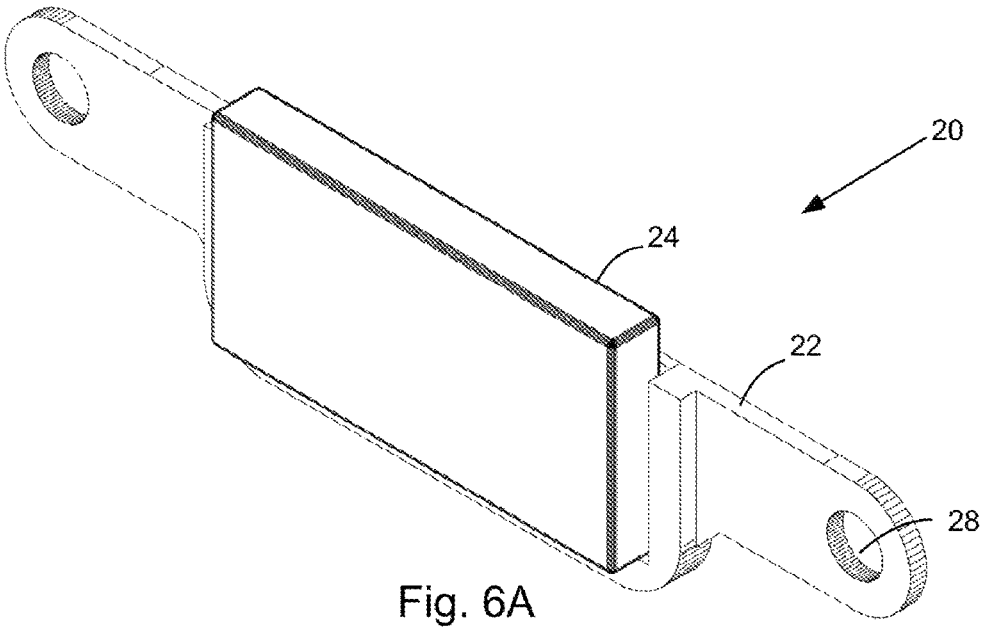
FIG. 6A is a rear right perspective view.
Figure 6B:
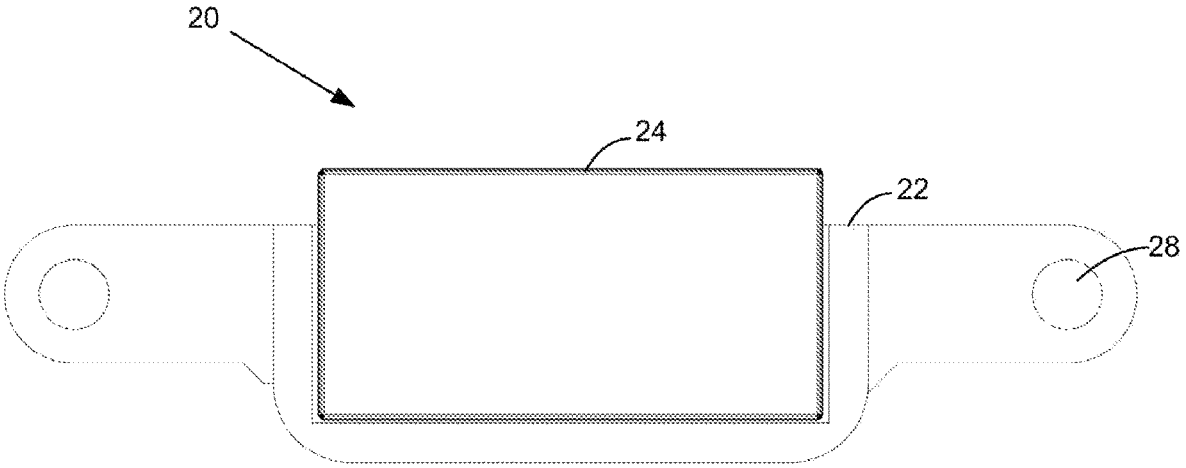
FIG. 6B is a rear view, of an example magnet assembly 20 that may be used to implement magnet assembly 20 in cover 10 of FIG. 4, in accordance with an embodiment of the disclosure.

Referring now to FIG. 6A and FIG. 6B, a rear right perspective view, and a rear view are respectively shown of an example magnet assembly 20 that may be used to implement magnet assembly 20 in cover 10 of FIG. 4, in accordance with an embodiment of the disclosure. Frame 22 partially surrounds magnet 24 on three sides, and is open on a side that faces into pocket 13 of FIG. 4. Extensions 26 locate holes 28 sufficiently far from magnet 24, so that the material of cover body 12 will flex to permit attachment of snap portions 11A, 11B without cracking or otherwise disrupting the appearance of cover 10. In general, this permits magnet 24 to extend the rear profile of cover body 12 rearward to facilitate engagement of cover 10 with magnetic surfaces, and improve the strength of the magnetic contact that secures cover 10 and the cap or other headgear/article to which cover 10 is attached.

Figure 7A:
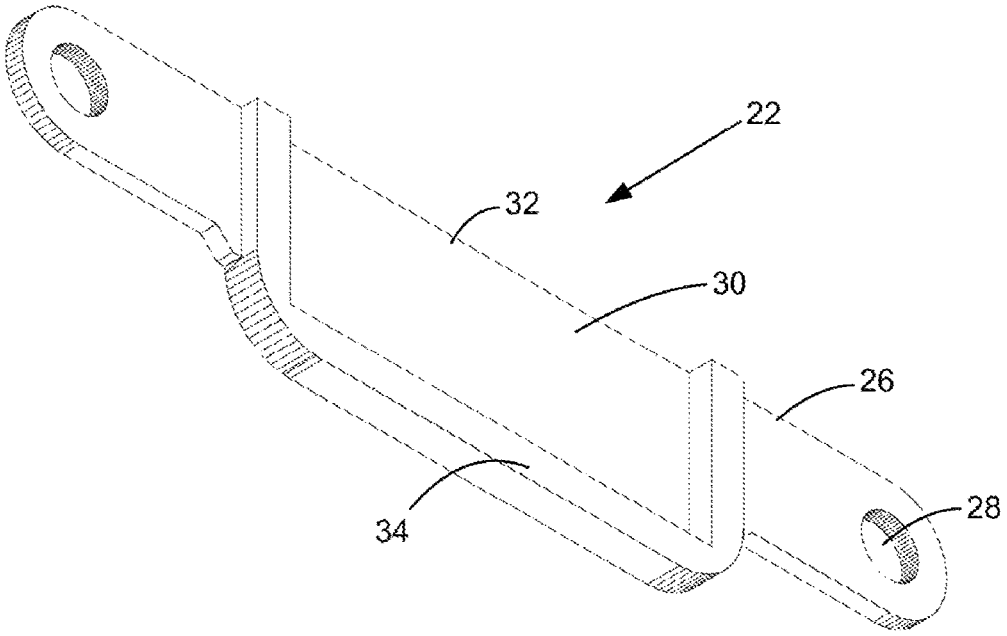
FIG. 7A is a rear left perspective view.
Figure 7B:
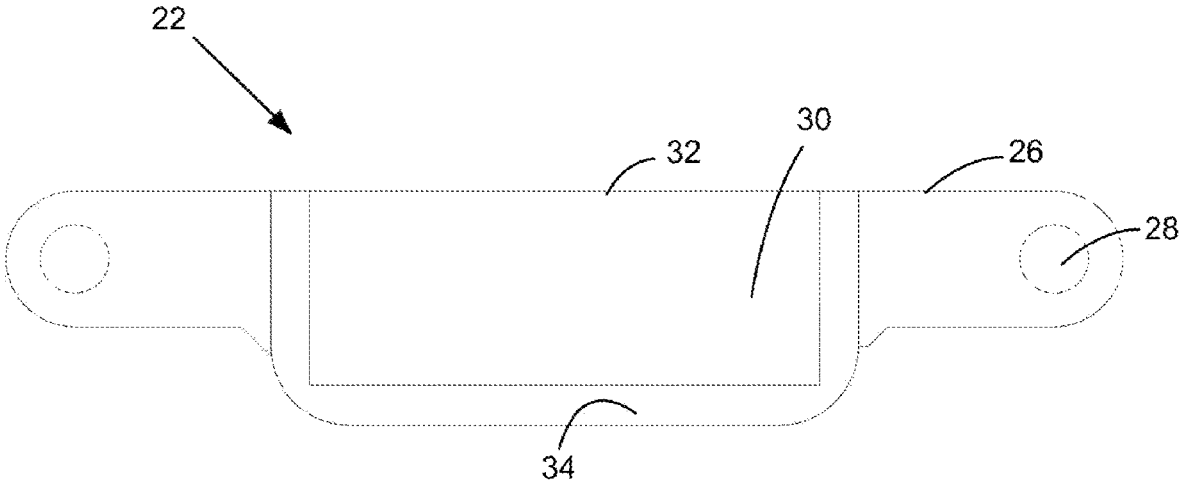
FIG. 7B is a rear view, of an example frame 24, that may be used to implement frame 24 in magnet assembly 20 of FIGS. 6A-6B, in accordance with an embodiment of the disclosure.

Referring now to FIG. 7A and FIG. 7B, a rear left perspective view, and a rear view, are respectively shown of an example frame 22, that may be used to implement frame 24 in magnet assembly 20 of FIGS. 6A-6B, in accordance with an embodiment of the disclosure. Frame 22 defines a recess 30 that accepts magnet 24, as shown in FIGS. 6A-6B, and which is bounded by a rim 34 that extends along a top side of frame 22 to secure magnet 24 within pocket 13 of cover, as shown in FIG. 4. When installed, magnet 24 extends past bottom edge 32 of frame 22 and is even with bottom edges of extensions 26. Frame may be molded, printed or otherwise formed from a plastic material, or alternatively another material sufficiently strong and durable to secure magnet 24 within cover 10.

Figure 8:
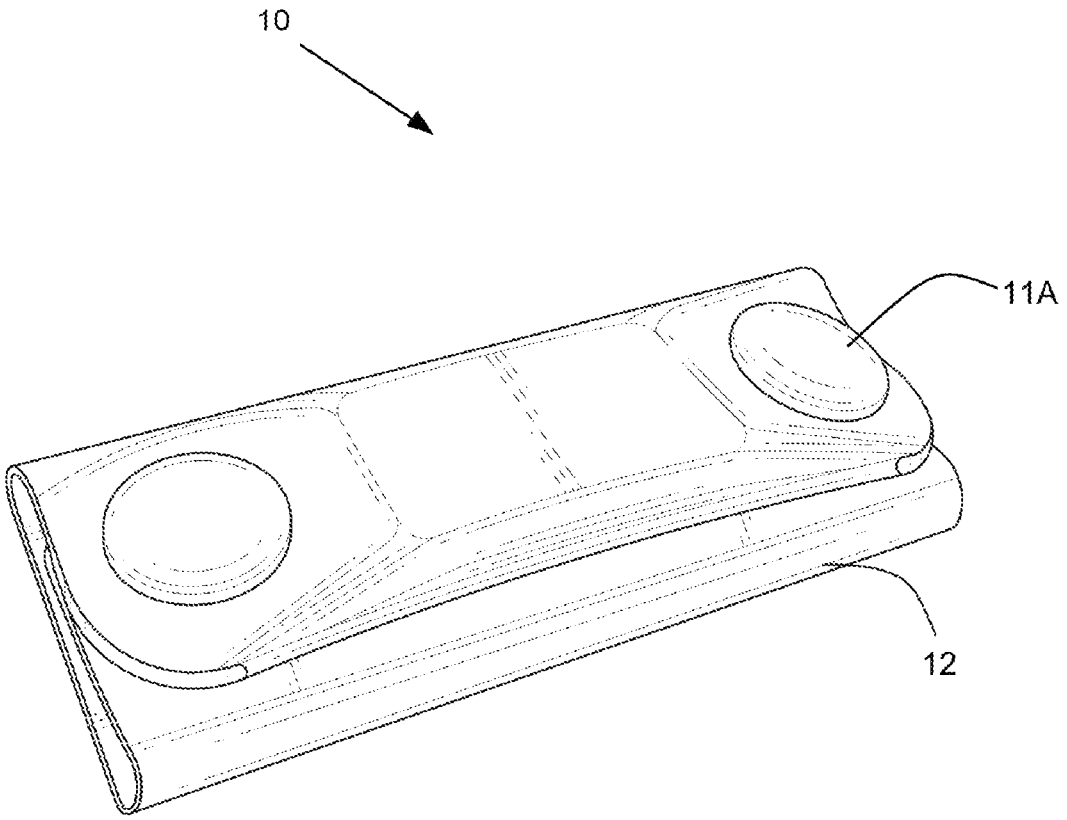
FIG. 8 is an upper-left perspective view showing design features of example cover 10, in accordance with an embodiment of the disclosure.
Figure 9:
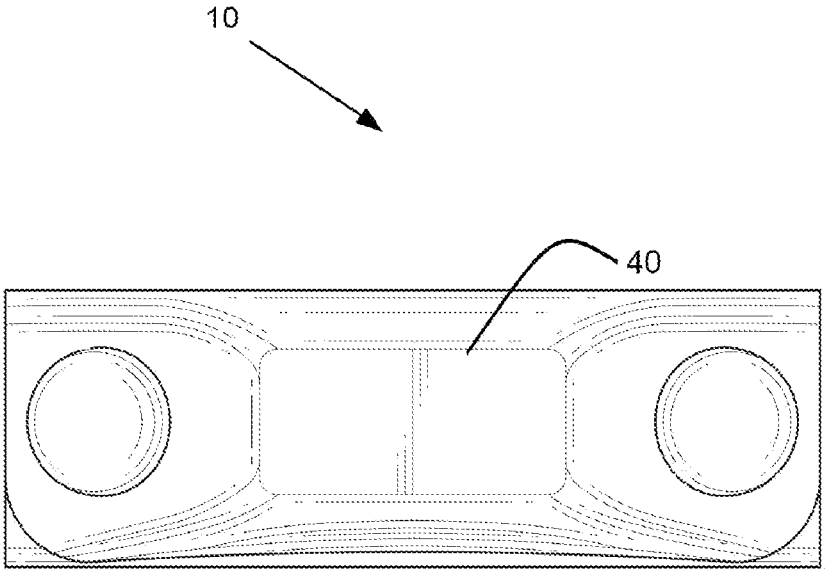
FIG. 9 is a rear view showing design features of example cover 10, in accordance with an embodiment of the disclosure.
Figure 10:
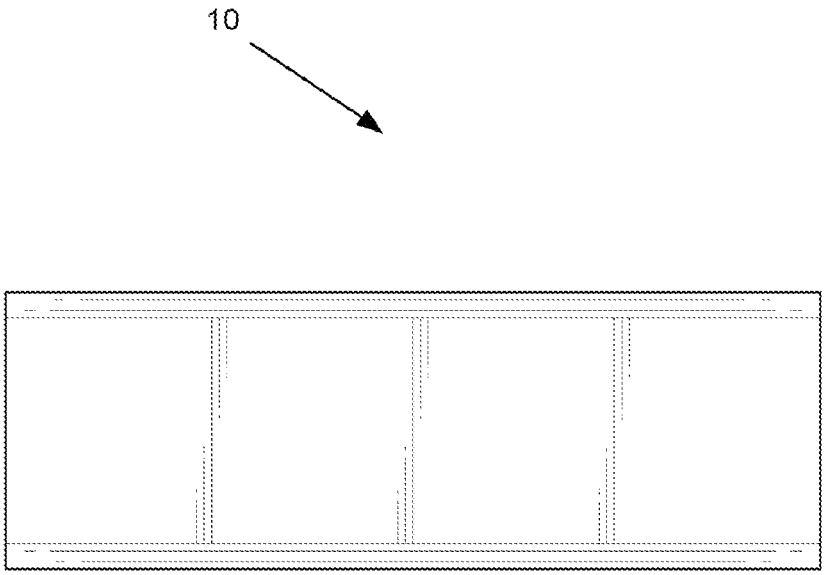
FIG. 10 is a front view showing design features of example cover 10, in accordance with an embodiment of the disclosure.
Figure 11:
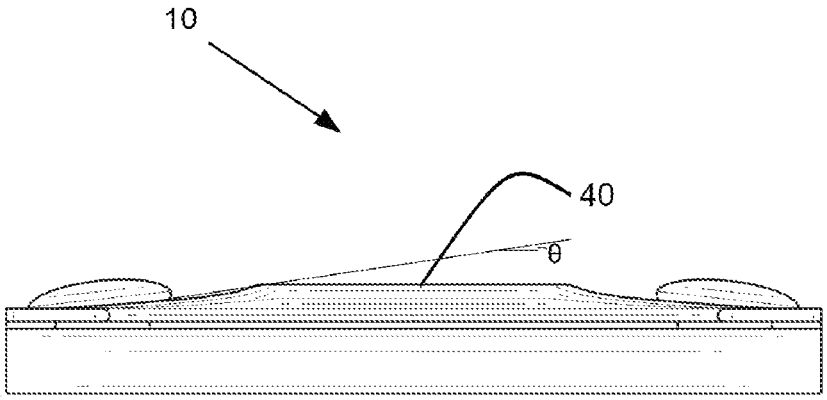
FIG. 11 is a top view showing design features of example cover 10, in accordance with an embodiment of the disclosure.
Figure 12:
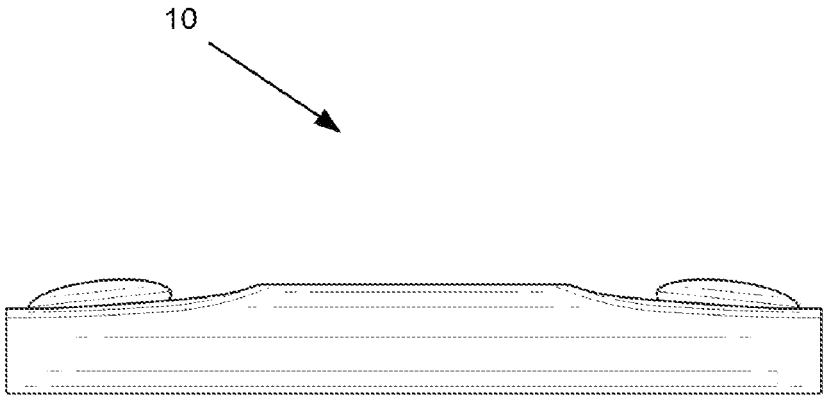
FIG. 12 is a bottom view showing design features of example cover 10, in accordance with an embodiment of the disclosure.
Figure 13:
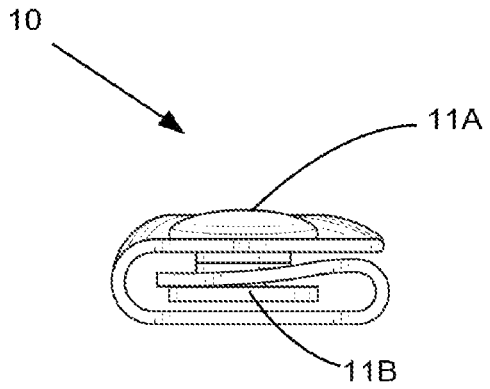
FIG. 13 is a left side view showing design features of example cover 10, in accordance with an embodiment of the disclosure.
Figure 14:
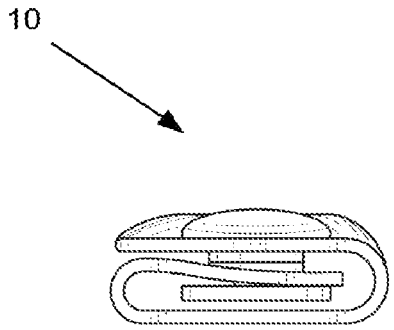
FIG. 14 is a right side view showing design features of example cover 10, in accordance with an embodiment of the disclosure.

Referring now to FIGS. 8-14, design features of example cover 10 are shown, in accordance with an embodiment of the disclosure. FIG. 8 is an upper-left perspective view showing design features of example cover 10. Cover body 12 slopes rearward/outward from the plane of cover 10 to form a prominence 40 that brings magnet 24 (not visible) inside cover 10 rearward to improve contact of the portion of cover body 12 over magnet 24 in better contact with magnetic surfaces. Snap portions 11A are sufficiently removed from magnet 24, so that, while snap portions 11A are inclined, they are still able to make contact with snap portions 11B (not visible). FIG. 9 is a rear view showing design features of example cover 10, with the location of prominence 40 shown with a rectangular profile due to the rectangular shape of magnet 24 (not visible). FIG. 10 is a front view showing design features of example cover 10, FIG. 11 is a top view showing design features of example cover 10, and further showing inclination angle θ, which is approximately 10 degrees with respect to the primary plane of cover 11 along a length of cover 10. FIG. 12 is a bottom view showing design features of example cover 10, FIG. 13 is a left side view and FIG. 14 is a right side view showing design features of example cover 10, with side profiles of snap portions 11A, 11B visible. In the example embodiments shown herein, a length of the cover along the central passage is approximately two and one-half inches, and a height of the cover when the fastening mechanism is secured together is approximately one inch.

Figure 15:
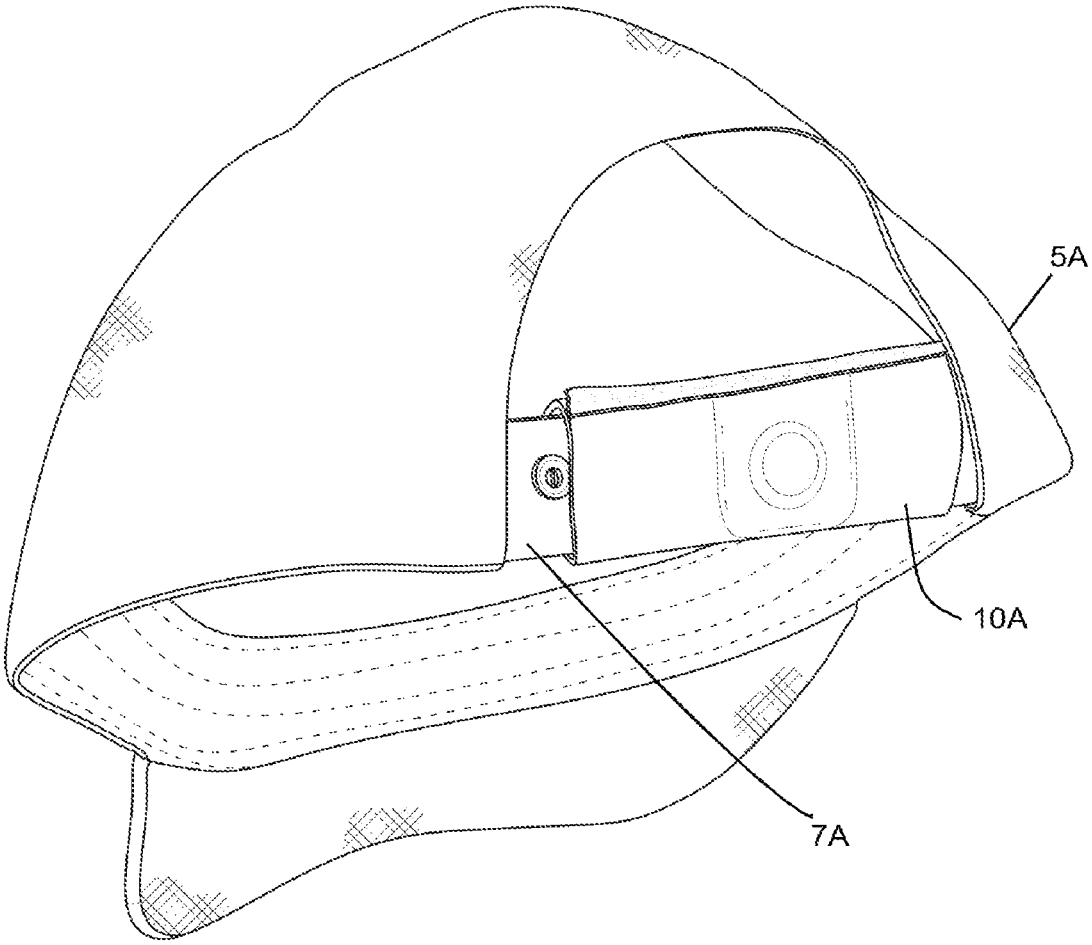
FIG. 15 is a pictorial view showing an example cover 10A, installed on a cap 5A, in accordance with another embodiment of the disclosure.
Figure 16:
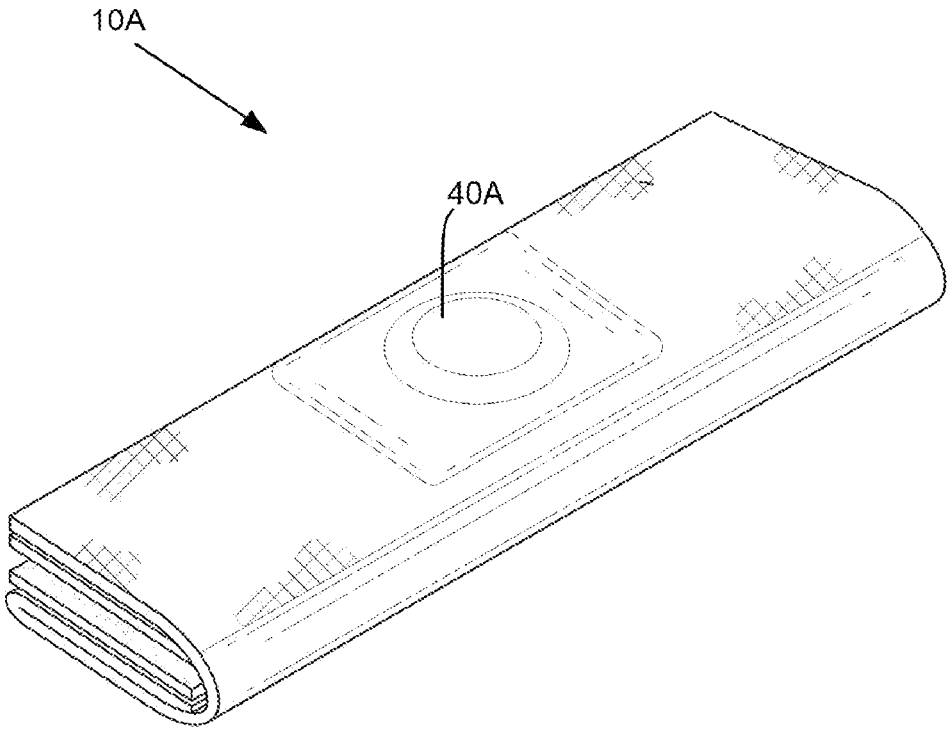
FIG. 16 is a bottom right rear perspective view showing design features of example cover 10A, in accordance with another embodiment of the disclosure.
Figure 17:
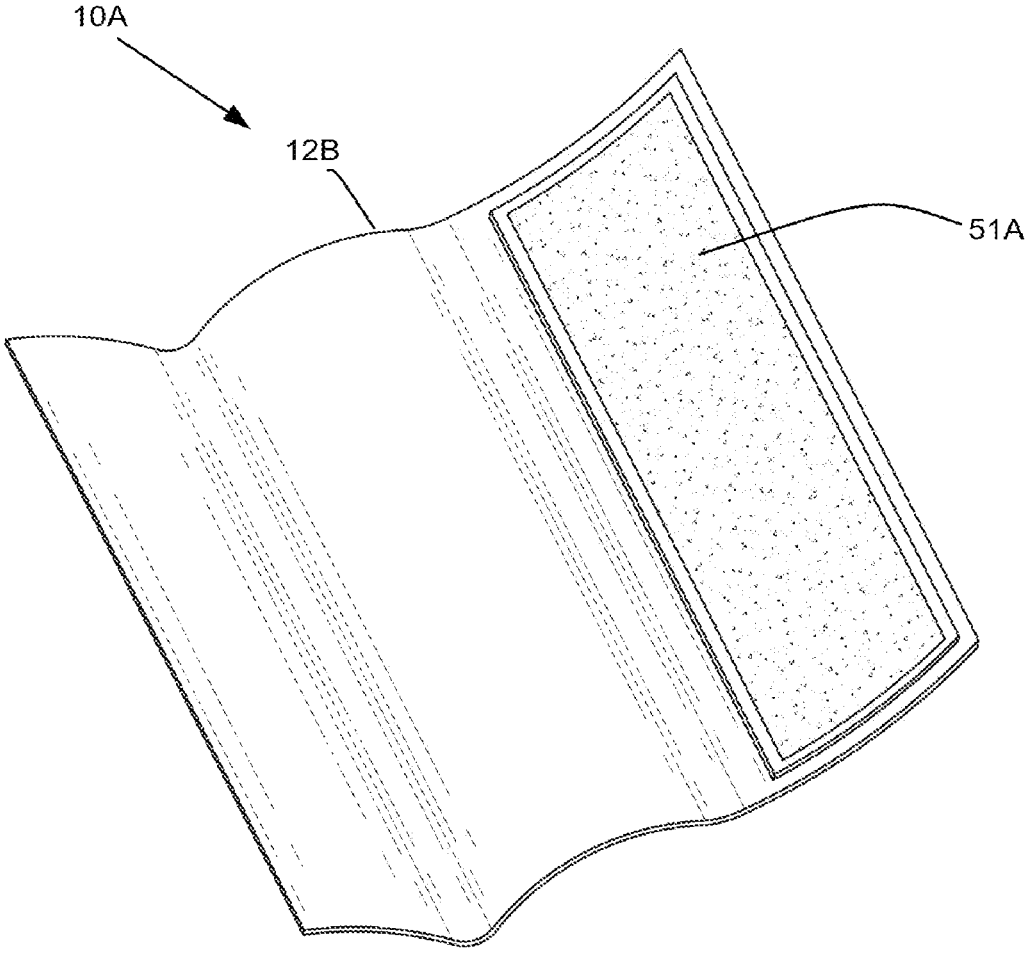
FIG. 17 is a inner perspective view of example cover 10A, in an opened configuration, in accordance with another embodiment of the disclosure.
Figure 18:
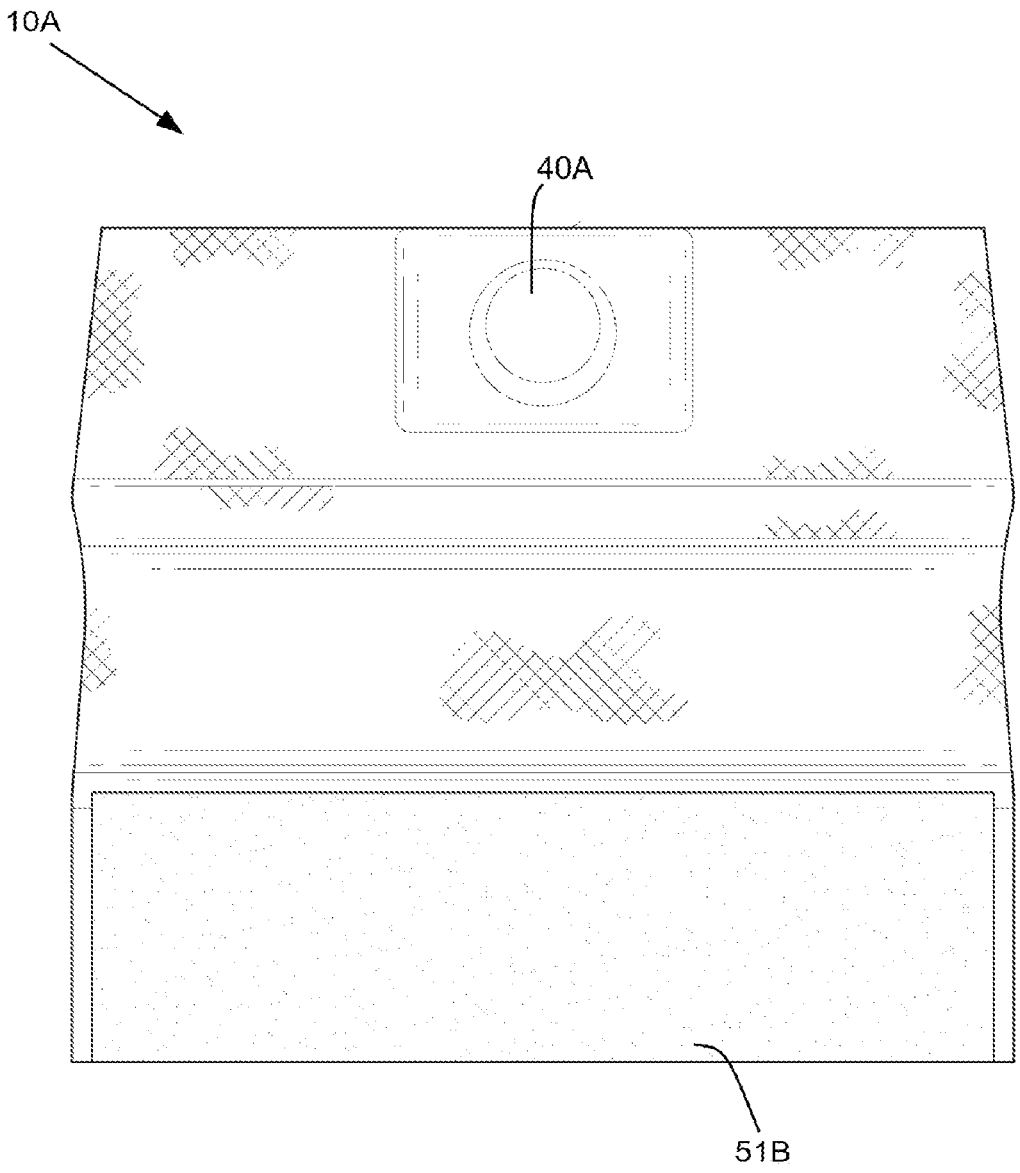
FIG. 18 is an outer view of example cover 10A, in an opened configuration, in accordance with another embodiment of the disclosure.
Figure 19:
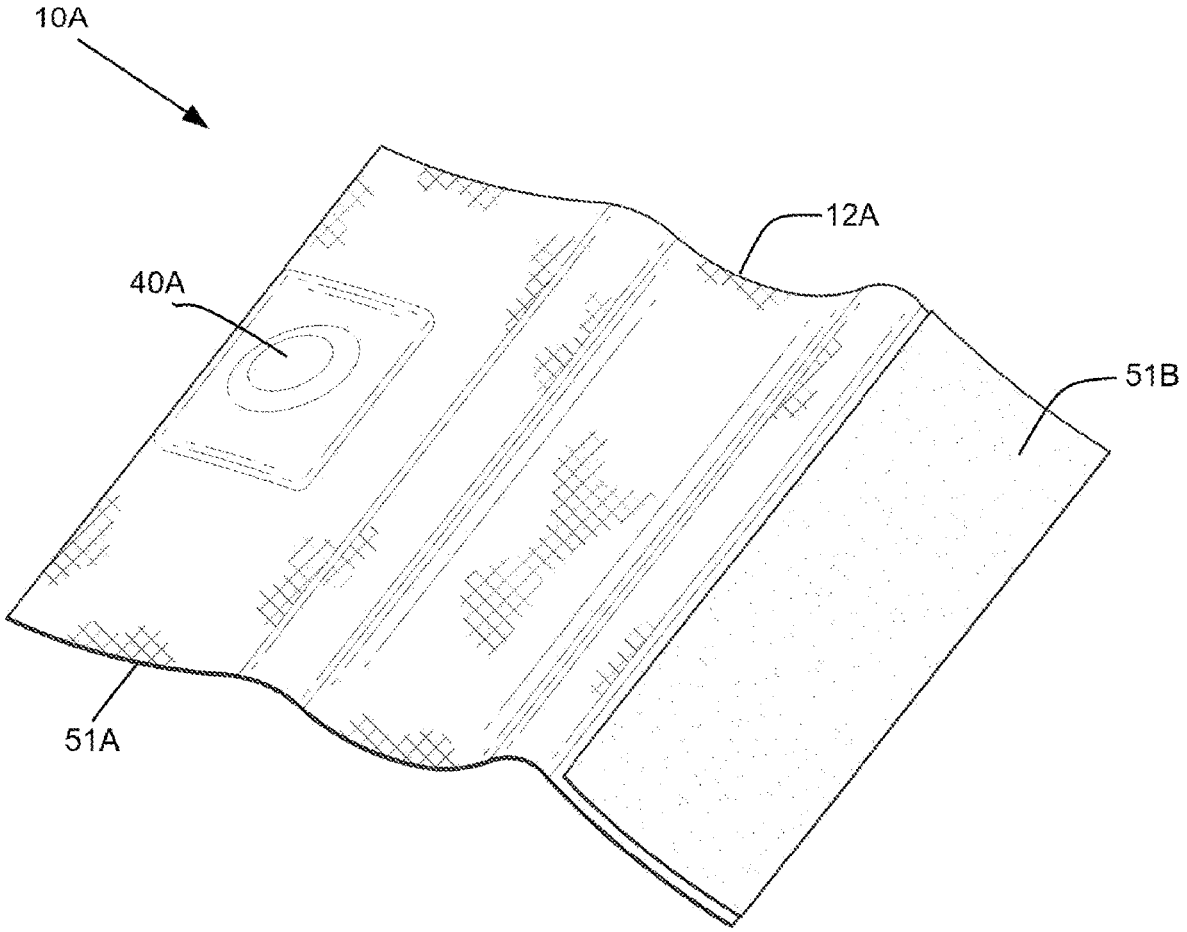
FIG. 19 is an outer perspective view of example cover 10A, in an opened configuration, in accordance with another embodiment of the disclosure.

Referring now to FIG. 15, a pictorial view showing an example cover 10A, installed on a closure strap 7A of a cap 5A is shown, in accordance with another embodiment of the disclosure. Referring now to FIGS. 16-19, design features of example cover 10A are shown, in accordance with another embodiment of the disclosure. FIG. 16 is a bottom right rear perspective view, displaying a prominence 40A due to an internal magnet having a circular profile. FIG. 17 is a inner perspective view of example cover 10A, in an opened configuration, showing a fastener portion 51A that is a portion of a hook-and-loop fastener attached to a cover body 12B that may be, for example, a stitched fabric cover body, or a sheet of material such as leather, a leather imitation, or plastic. FIG. 18 is an outer view of example cover 10A, in an opened configuration, showing a location of another fastener portion 51B of the hook-and-loop fastener, which makes contact with fastener portion 51A, when cover 10A is wrapped around closure strap 7A of cap 5A. FIG. 19 is an outer perspective view of example cover 10A, in an opened configuration.

In summary, this disclosure shows and describes example covers for covering a headgear closure strap, which include a cover body that defines a central passage for accepting the headgear closure strap. The cover body may be configured to encircle a cross-sectional profile of the headgear closure strap and may extend along at least a portion of the extension of the headgear closure strap. The covers also include a magnet disposed inside of the cover body behind a rear outer face of the cover body when the cover body is installed on headgear, and a fastening mechanism for securing a top and a bottom wrap portion of the cover body together in front of a front inner face of the cover body when the cover body is installed on the headgear.

In some example embodiments, the cover body is formed from a sheet of flexible material having a semi-rectangular outline, and an edge of the sheet of flexible material may be folded over and fastened to the remainder of the sheet of the material to form a pocket in which the magnet is retained. In some example embodiments, the fastening mechanism may include a complementary pair of hook-and-loop fastener sheets. One of the fastener sheets may be mounted on a lower front face of the sheet of flexible material, and another one of the sheets may be mounted on an upper rear face of the sheet of flexible material, so that when the cover body is wrapped around the closure strap, outer faces of the pair of hook-and-loop fastener sheets may make contact to secure the cover body around the closure strap. In some example embodiments, wherein the fastening mechanism may include a pair of snaps, and first portions of the pair of snaps may be mounted through a lower front face of the sheet of flexible material, while second portions of the pair of snaps may be mounted through an upper rear face of the sheet of flexible material, so that when the cover body is wrapped around the closure strap, active ends of the first and second portions of the pair of snaps may be fastened together to secure the cover body around the closure strap. In some example embodiments, the second portions of the pair of snaps may be outer button portions that are visible on an outer rear face of the cover when the cover is installed on the headgear, and the second portions of the pair of snaps may secure the edge of the sheet of flexible material that is folded over to form the pocket.

In some example embodiments, the covers may further include a frame for retaining the magnet within the pocket, and the frame may include a frame rim having a shape conformed to an outer profile of the magnet, and defining side edges and a bottom edge that at least partially surround the magnet on at least three sides. The frame may also include a pair of extensions extending from sides of the frame past the centers of the second portions of the pair of snaps and defining voids positioned at the centers of the second portions of the pair of snaps for accepting posts of the second portions of the pair of snaps. The frame and the magnet may be retained within the pocket by the posts of the second portions of the pair of snaps. In some example embodiments, the frame may further include a plate behind which the frame rim is formed, the frame rim may define a cavity in front of the plate, and the extensions may be extensions of the plate. The magnet may be mounted in the cavity with a rear face of the magnet contacting the plate within the cavity, so that the plate positions the magnet rearward in the pocket against the cover body, so that the cover body magnet flexes rearward in the cover to facilitate contact of the cover with an external magnetic surface. In some example embodiments, a length of the cover along the central passage may be approximately double a length of the magnet and wherein the pair of snaps may be located on either side of the magnet at a distance that provides relief for the flexible material to bend and allows projection of the magnet rearward by the frame to a distance of 75% or more of a height of the magnet above the base.

In some example embodiments, the pair snaps may be disposed on either side of the magnet to prevent interference of outer faces of the snaps with contact of the magnet with a magnetic surface. In some example embodiments, a length of the cover along the central passage may be approximately two and one-half inches, and a height of the cover when the fastening mechanism is secured together may be approximately one inch.

While the disclosure has shown and described particular embodiments of the techniques disclosed herein, it will be understood by those skilled in the art that the foregoing and other changes in form, and details may be made therein without departing from the spirit and scope of the disclosure. For example, the design concepts shown above may be applied to other types of clothing accessories.

What is claimed is:

1. A cover for covering a headgear closure strap, the cover comprising:

a cover body defining a central passage for accepting the headgear closure strap, wherein the cover body is configured to encircle a cross-sectional profile of the headgear closure strap and extend along at least a portion of the extension of the headgear closure strap, wherein the cover body is formed from a sheet of flexible material having a semi-rectangular outline;

a magnet disposed inside of the cover body behind a rear outer face of the cover body when the cover body is installed on the headgear closure strap, wherein an edge of the sheet of flexible material is folded over and fastened to the remainder of the sheet of the material to form a pocket in which the magnet is retained;

a fastening mechanism for securing a top and a bottom wrap portion of the cover body together in front of a front inner face of the cover body when the cover body is installed on the headgear closure strap, wherein the fastening mechanism comprises a pair of snaps, wherein first portions of the pair of snaps are mounted through a lower front face of the sheet of flexible material, and wherein second portions of the pair of snaps are mounted through an upper rear face of the sheet of flexible material, so that when the cover body is wrapped around the closure strap, active ends of the first and second portions of the pair of snaps may be fastened together to secure the cover body around the closure strap; and a frame for retaining the magnet within the pocket, the frame comprising a frame rim having a shape conformed to an outer profile of the magnet, and defining side edges and a bottom edge that at least partially surround the magnet on at least three sides, and a pair of extensions extending from sides of the frame past the centers of the second portions of the pair of snaps and defining voids positioned at the centers of the second portions of the pair of snaps for accepting posts of the second portions of the pair of snaps, wherein the frame and the magnet are retained within the pocket by the posts of the second portions of the pair of snaps.

2. The cover of claim 1, wherein the second portions of the pair of snaps are outer button portions that are visible on an outer rear face of the cover when the cover is installed on the headgear closure strap, wherein the second portions of the pair of snaps secure the edge of the sheet of flexible material that is folded over to form the pocket.

3. The cover of claim 1, wherein the frame further comprises a plate behind which the frame rim is formed, wherein the frame rim defines a cavity in front of the plate, wherein the extensions are extensions of the plate, and wherein the magnet is mounted in the cavity with a rear face of the magnet contacting the plate within the cavity, so that the plate positions the magnet rearward in the pocket against the cover body, and so that the cover body magnet flexes rearward in the cover to facilitate contact of the cover with an external magnetic surface.

4. The cover of claim 3, wherein a length of the cover along the central passage is approximately double a length of the magnet, and wherein the pair of snaps are located on either side of the magnet at a distance that provides relief for the flexible material to bend and allow projection of the magnet rearward by the frame to a distance of 75% or more of a height of the magnet above the base.

5. The cover of claim 1, wherein the pair of snaps are disposed on either side of the magnet, to prevent interference of outer faces of the snaps with contact of the magnet with a magnetic surface.

6. The cover of claim 1, wherein a length of the cover along the central passage is approximately two and one-half inches, and wherein a height of the cover when the fastening mechanism is secured together is approximately one inch.

7. A method of detachably retaining headgear to a magnetic surface, the method comprising:

forming a cover body from a sheet of flexible material having a semi-rectangular outline;

covering a headgear closure strap of the headgear with a cover that includes the cover body and defining a central passage for accepting the headgear closure strap, wherein the cover body is configured to encircle a cross-sectional profile of the headgear closure strap and extend along at least a portion of the extension of the headgear closure strap, wherein the covering comprises folding an edge of the sheet of flexible material over and fastening the edge of the sheet of flexible material to the remainder of the sheet of flexible material to form a pocket, and wherein the installing the magnet installs the magnet in the pocket so that the magnet is retained;

securing the cover body around the headgear closure strap with a fastening mechanism including a pair of snaps, wherein the fastening mechanism secures securing a top and a bottom wrap portion of the cover body together in front of a front inner face of the cover body when the cover body is installed on the headgear, and wherein the securing comprises mounting first portions of the pair of snaps through a lower front face of the sheet of flexible material, and mounting second portions of the pair of snaps through an upper rear face of the sheet of flexible material, so that when the cover body is wrapped around the closure strap, active ends of the first and second portions of the pair of snaps may be fastened together to secure the cover body around the closure strap;

installing a magnet disposed inside of the cover body behind a rear outer face of the cover body when the cover body is installed on headgear;

installing a frame for retaining the magnet within the pocket, wherein the frame includes a frame rim having a shape conformed to an outer profile of the magnet, and defining side edges and a bottom edge that at least partially surround the magnet on at least three sides, and a pair of extensions extending from sides of the frame past the centers of the second portions of the pair of snaps and defining voids positioned at the centers of the second portions of the pair of snaps for accepting posts of the second portions of the pair of snaps;

retaining the frame and the magnet within the pocket using the posts of the second portions of the pair of snaps; and bringing the cover in contact with the magnetic surface, whereby the headgear is detachably retained to the magnetic surface.

8. The method of claim 7, wherein the second portions of the pair of snaps are outer button portions that are visible on an outer rear face of the cover when the cover is installed on the headgear, wherein the second portions of the pair of snaps secure the edge of the sheet of flexible material that is folded over to form the pocket.

9. The method of claim 7, wherein the frame further includes a plate behind which the frame rim is formed, wherein the frame rim defines a cavity in front of the plate, wherein the extensions are extensions of the plate, and wherein the installing the magnet mounts the magnet in the cavity with a rear face of the magnet contacting the plate within the cavity, so that the plate positions the magnet rearward in the pocket against the cover body, and so that the cover body magnet flexes rearward in the cover to facilitate contact of the cover with an external magnetic surface.

10. The method of claim 9, wherein a length of the cover along the central passage is approximately double a length of the magnet and wherein the pair of snaps are located on either side of the magnet at a distance that provides relief for the flexible material to bend and allow projection of the magnet rearward by the frame to a distance of 75% or more of a height of the magnet above the base.

11. The method of claim 7, wherein the pair of snaps are disposed on either side of the magnet, to prevent interference of outer faces of the snaps with contact of the magnet with a magnetic surface.

12. The method of claim 7, wherein a length of the cover along the central passage is approximately two and one-half inches, and wherein a height of the cover when the fastening mechanism is secured together is approximately one inch.

* * * * *